US008007371B2

(12) United States Patent
Breier et al.

(10) Patent No.: US 8,007,371 B2
(45) Date of Patent: Aug. 30, 2011

(54) GOLF CLUB HEAD WITH CONCAVE INSERT

(75) Inventors: Joshua G. Breier, Vista, CA (US); Peter L. Soracco, Carlsbad, CA (US); Scott A. Rice, San Diego, CA (US); Gregory Haralson, Laguna Niguel, CA (US)

(73) Assignee: Cobra Golf, Inc., Carlsbad, CA (US)

( * ) Notice: Subject to any disclaimer, the term of this patent is extended or adjusted under 35 U.S.C. 154(b) by 296 days.

(21) Appl. No.: 12/076,322

(22) Filed: Mar. 17, 2008

(65) Prior Publication Data

US 2008/0268980 A1 Oct. 30, 2008

Related U.S. Application Data

(63) Continuation-in-part of application No. 11/363,098, filed on Feb. 28, 2006, now Pat. No. 7,524,249, which is a continuation-in-part of application No. 11/110,733, filed on Apr. 21, 2005, and a continuation-in-part of application No. 11/180,406, filed on Jul. 13, 2005, now Pat. No. 7,377,860, application No. 12/076,322, which is a continuation-in-part of application No. 29/276,256, filed on Jan. 19, 2007, now Pat. No. Des. 567,888.

(51) Int. Cl.
*A63B 53/04* (2006.01)

(52) U.S. Cl. ..... 473/342; 473/345; 473/349

(58) Field of Classification Search ..... 473/324–350, 473/287–292
See application file for complete search history.

(56) References Cited

U.S. PATENT DOCUMENTS

| | | | | | |
|---|---|---|---|---|---|
| 1,349,806 | A | * | 8/1920 | Booth | 473/344 |
| 1,361,258 | A | * | 12/1920 | Horton | 473/343 |
| 1,412,650 | A | * | 4/1922 | Booth | 473/342 |
| 1,452,845 | A | * | 4/1923 | Pryde | 473/343 |
| 1,455,379 | A | * | 5/1923 | Allen | 473/337 |
| 1,552,297 | A | * | 9/1925 | Harness | 473/344 |

(Continued)

FOREIGN PATENT DOCUMENTS

JP 08-089603 4/1996

(Continued)

OTHER PUBLICATIONS

U.S. Patent Publication No. 2006/0052181.

(Continued)

*Primary Examiner* — Sebastiano Passaniti
(74) *Attorney, Agent, or Firm* — Knobbe, Martens, Olson & Bear LLP

(57) ABSTRACT

A hollow golf club head with a concave portion is disclosed and claimed. The club head includes a metallic portion and a light-weight portion, which may be formed of plastic, composite, or the like. The concave portion allows the club designer to make a club head having very thin portions while still maintaining the requisite structural integrity. Convex bulges may optionally be provided to house weight inserts to enhance the playing characteristics of the golf club. The metallic portion of the club head may take on the appearance of a frame, into which several light-weight inserts are positioned. These light-weight inserts may be positioned in the crown, skirt, and sole of the club head. The club head is thus contoured such that its surface area is substantially large. The club head may also be formed of a single, relatively light-weight material.

4 Claims, 15 Drawing Sheets

U.S. PATENT DOCUMENTS 1,559,299 A * 10/1925 Barach ..... 473/306
1,574,213 A * 2/1926 Tyler ..... 473/338
1,575,364 A * 3/1926 Hodgkins ..... 473/311
1,705,997 A * 3/1929 Quynn ..... 473/329
3,166,320 A 1/1965 Onions ..... 473/314
3,556,533 A 1/1971 Hollis
3,941,390 A 3/1976 Hussey ..... 273/169
3,966,210 A 6/1976 Rozmus ..... 473/341
D240,644 S * 7/1976 Manfrin ..... D21/745
3,985,363 A * 10/1976 Jepson et al. ..... 473/309
4,021,047 A 5/1977 Mader ..... 273/167 H
4,043,563 A 8/1977 Churchward
4,085,934 A 4/1978 Churchward
4,193,601 A * 3/1980 Reid et al. ..... 473/342
D262,049 S * 11/1981 Simmons ..... D21/752
4,432,549 A 2/1984 Zebelean
4,438,931 A 3/1984 Motomiya
4,653,756 A 3/1987 Sato ..... 273/167 E
4,762,322 A 8/1988 Molitor et al.
4,792,140 A 12/1988 Yamaguchi et al. ..... 473/331
4,869,507 A 9/1989 Sahm ..... 473/337
4,872,683 A 10/1989 Doran et al. ..... 473/249
4,872,685 A * 10/1989 Sun ..... 473/349
4,883,275 A * 11/1989 Boone ..... 473/334
5,186,465 A 2/1993 Chorne ..... 273/167 H
5,205,560 A 4/1993 Hoshi et al. ..... 473/345
5,213,328 A 5/1993 Long et al. ..... 273/167 H
5,255,913 A 10/1993 Tsuchida ..... 473/329
5,272,802 A 12/1993 Stites, III ..... 29/527.2
5,310,186 A 5/1994 Karsten ..... 273/171
5,346,217 A 9/1994 Tsuchiya et al. ..... 473/345
5,435,558 A 7/1995 Iriarte ..... 273/167 E
5,447,309 A 9/1995 Vincent
5,474,297 A * 12/1995 Levin ..... 473/328
5,484,155 A 1/1996 Yamawaki et al.
5,547,188 A 8/1996 Dumontier et al.
5,624,331 A 4/1997 Lo et al. ..... 473/345
5,665,014 A 9/1997 Sanford et al.
5,769,736 A 6/1998 Sato ..... 473/335
5,785,609 A 7/1998 Sheets et al. ..... 473/327
5,797,176 A * 8/1998 Rose et al. ..... 29/527.5
5,842,935 A * 12/1998 Nelson ..... 473/342
5,935,020 A 8/1999 Stites et al.
5,947,840 A 9/1999 Ryan ..... 473/335
5,997,415 A 12/1999 Wood ..... 473/346
D418,885 S 1/2000 Wanchena ..... D21/733
6,012,989 A 1/2000 Saksun ..... 473/341
6,059,669 A * 5/2000 Pearce ..... 473/339
6,074,308 A * 6/2000 Domas ..... 473/327
6,077,171 A 6/2000 Yoneyama
6,089,994 A 7/2000 Sun
6,123,627 A 9/2000 Antonious ..... 473/327
6,139,446 A 10/2000 Wanchena ..... 473/349
6,149,534 A * 11/2000 Peters et al. ..... 473/345
6,162,133 A 12/2000 Peterson ..... 473/345
6,183,377 B1 2/2001 Liang ..... 473/324
6,217,461 B1 4/2001 Galy ..... 473/328
6,248,025 B1 6/2001 Murphy et al. ..... 473/324
6,248,026 B1 6/2001 Wanchena ..... 473/349
6,254,494 B1 7/2001 Hasebe et al.
6,332,848 B1 12/2001 Long et al. ..... 473/328
6,340,337 B2 1/2002 Hasebe et al.
6,354,962 B1 3/2002 Galloway et al. ..... 473/342
6,409,612 B1 6/2002 Evans et al. ..... 473/324
6,422,951 B1 7/2002 Burrows ..... 473/328
6,440,009 B1 8/2002 Guibaud et al. ..... 473/334
6,471,604 B2 10/2002 Hocknell et al.
6,482,106 B2 11/2002 Saso ..... 473/327
6,565,452 B2 5/2003 Helmstetter et al. ..... 473/342
6,572,491 B2 6/2003 Hasebe et al.
6,575,845 B2 6/2003 Galloway et al. ..... 473/329
6,592,468 B2 7/2003 Vincent et al.
6,623,378 B2 * 9/2003 Beach et al. ..... 473/345
6,645,086 B1 11/2003 Chen ..... 473/335
6,648,773 B1 11/2003 Evans ..... 473/342
6,716,114 B2 4/2004 Nishio
6,739,983 B2 * 5/2004 Helmstetter et al. ..... 473/342
6,739,984 B1 5/2004 Ciasullo ..... 473/345
6,773,360 B2 8/2004 Willett et al. ..... 473/334
6,776,723 B2 8/2004 Bliss et al.
6,860,818 B2 3/2005 Mahaffey et al. ..... 473/256
6,872,152 B2 3/2005 Beach et al. ..... 473/324
6,890,267 B2 5/2005 Mahaffey et al.
6,896,625 B2 5/2005 Grace
6,902,497 B2 * 6/2005 Deshmukh et al. ..... 473/342
6,913,546 B2 7/2005 Kakiuchi
6,926,615 B1 8/2005 Souza et al.
6,929,565 B2 8/2005 Nakahara et al. ..... 473/345
6,932,875 B2 8/2005 Cheng et al.
6,955,612 B2 10/2005 Lu ..... 473/324
6,991,558 B2 1/2006 Beach et al.
7,008,332 B2 3/2006 Liou ..... 473/345
7,022,030 B2 * 4/2006 Best et al. ..... 473/340
7,025,692 B2 4/2006 Erickson et al. ..... 473/335
7,070,517 B2 7/2006 Cackett et al. ..... 473/342
7,128,664 B2 * 10/2006 Onoda et al. ..... 473/347
7,140,974 B2 11/2006 Chao et al. ..... 473/329
7,147,573 B2 12/2006 DiMarco ..... 473/324
7,160,040 B2 1/2007 Matsushima ..... 400/62
7,163,468 B2 1/2007 Gibbs et al. ..... 473/329
7,166,038 B2 1/2007 Williams et al. ..... 473/329
7,169,060 B2 1/2007 Stevens et al.
7,175,541 B2 * 2/2007 Lo ..... 473/345
7,186,190 B1 3/2007 Beach et al.
7,204,768 B2 4/2007 Nakahara et al.
7,252,599 B2 8/2007 Haseguwa
7,258,625 B2 8/2007 Kawaguchi et al. ..... 473/329
7,281,993 B2 10/2007 Oyama
7,303,487 B2 12/2007 Kumamoto ..... 473/345
7,338,390 B2 3/2008 Lindsay
D567,888 S 4/2008 Soracco ..... D21/752
7,371,191 B2 5/2008 Sugimoto ..... 473/345
7,377,860 B2 5/2008 Breier et al. ..... 473/334
7,524,249 B2 4/2009 Breier et al. ..... 473/342
7,530,901 B2 * 5/2009 Imamoto et al. ..... 473/334
7,549,933 B2 * 6/2009 Kumamoto ..... 473/329
7,632,195 B2 * 12/2009 Jorgensen ..... 473/345
7,658,686 B2 2/2010 Soracco
7,753,809 B2 7/2010 Cackett et al.
7,803,065 B2 9/2010 Breier et al.
2002/0077195 A1 * 6/2002 Carr et al. ..... 473/328
2002/0160858 A1 10/2002 Lee
2003/0134690 A1 * 7/2003 Chen ..... 473/345
2003/0162608 A1 * 8/2003 Chen ..... 473/345
2006/0100032 A1 5/2006 Imamoto et al.
2006/0116218 A1 * 6/2006 Burnett et al. ..... 473/349
2007/0054751 A1 3/2007 Breier et al.
2007/0060414 A1 3/2007 Breier et al.
2008/0070721 A1 * 3/2008 Chen et al. ..... 473/346
2008/0227564 A1 9/2008 Breier et al.
2008/0242445 A1 * 10/2008 Mergy et al. ..... 473/345
2010/0041490 A1 * 2/2010 Boyd et al. ..... 473/288
2010/0105499 A1 4/2010 Roach et al.
2010/0130304 A1 5/2010 Soracco
2010/0130305 A1 5/2010 Soracco

FOREIGN PATENT DOCUMENTS

JP 09-192269 7/1997
JP 2000-024149 1/2000
JP 2002-336389 11/2002
JP 2003-093554 4/2003
JP 2003-310808 11/2003
JP 2004-121744 4/2004
JP 2004-159680 6/2004
JP 2004-337327 12/2004
JP 2006-25929 2/2006
JP 2006-130065 5/2006
WO WO2004/052472 6/2004

OTHER PUBLICATIONS

U. S. Patent Publication No. 2006/0052177.
U.S. Patent Publication No. 2006/0014592.
U.S. Patent Publication No. 2005/0272527.
U.S. Patent Publication No. 2005/0215354.
U.S. Patent Publication No. 2005/0170907.
U.S. Patent Publication No. 2005/0159243.

U.S. Patent Publication No. 2005/0119070.
U.S. Patent Publication No. 2004/0254030.
U.S. Patent Publication No. 2004/0242343.
U.S. Patent Publication No. 2004/0192468.
U.S. Patent Publication No. 2004/0176177.
U.S. Patent Publication No. 2004/0138002.
U.S. Patent Publication No. 2003/0144078.
U.S. Patent Publication No. 2003/0100381.
U.S. Patent Publication No. 2003/0045371.
U.S. Patent Publication No. 2002/0137576.
U.S. Patent Publication No. 2002/0045490.
U.S. Patent Publication No. 2001/0049310.
U.S. Patent Publication No. 2001/0001302.
Non-Final Office Action dated May 20, 2009 of corresponding U.S. Appl. No. 11/110,733.
Final Office Action dated Oct. 1, 2008 of corresponding U.S. Appl. No. 11/110,733.
Non-Final Office Action dated Dec. 31, 2007 of corresponding U.S. Appl. No. 11/110,733.
Non-Final Office Action dated Jun. 5, 2007 of corresponding U.S. Appl. No. 11/110,733.
Notice of Allowance dated Dec. 31, 2008 of corresponding U.S. Appl. No. 11/363,098.
Non-Final Office Action dated Jun. 12, 2008 of corresponding U.S. Appl. No. 11/363,098.
Non-Final Office Action dated Oct. 27, 2009 of corresponding U.S. Appl. No. 11/591,588.
Non-Final Office Action dated Dec. 7, 2009 of corresponding U.S. Appl. No. 11/898,756.
Non-Final Office Action dated Nov. 13, 2009 of corresponding U.S. Appl. No. 11/600,081.
Notice of Allowance dated Sep. 28, 2009 of corresponding U.S. Appl. No. 11/110,733.
Jackson, Jeff, The Modern Guide to Golf Clubmaking. Ohio: Dynacraft Golf Products, Inc. copyright 1994, p. 239.
Japanese Office Action for Application No. 2007-311561, dated Jun. 30, 2010, in 7 pages.
Japanese Office Action titled Pretrial Reexamination Report for Japanese Application No. 2007-085624, (Appeal Trial No. 2010-009497), dated Jul. 7, 2010, in 6 pages.

* cited by examiner

GOLF CLUB HEAD WITH CONCAVE INSERT

CROSS-REFERENCE TO RELATED APPLICATIONS

This is a continuation-in-part of U.S. patent application Ser. No. 11/363,098 filed on Feb. 28, 2006, now U.S. Pat. No. 7,524,249, which is 1) a continuation-in-part of U.S. patent application Ser. No. 11/110,733 filed on Apr. 21, 2005, now pending, and 2) a continuation-in-part of U.S. patent application Ser. No. 11/180,406 filed on Jul. 13, 2005, now U.S. Pat. No. 7,377,860. This application is also a continuation-in-part of U.S. patent application Ser. No. 29/276,256, filed Jan. 19, 2007, now U.S. Design Pat. No. D567,888. Each of these applications is incorporated herein by reference in its entirety.

BACKGROUND OF THE INVENTION

1. Field of the Invention

The present invention relates to a golf club, and, more particularly, the present invention relates to a large wood-type golf club head with a concave insert.

2. Description of the Related Art

Golf club heads come in many different forms and makes, such as wood- or metal-type (including drivers and fairway woods), iron-type (including wedge-type club heads), utility- or specialty-type, and putter-type. Each of these styles has a prescribed function and make-up. The present invention primarily relates to hollow golf club heads, such as wood-type and utility-type (generally referred to herein as wood-type golf clubs).

Wood-type type golf club heads generally include a front or striking face, a crown, a sole, and an arcuate skirt including a heel, a toe, and a back. The crown and skirt are sometimes referred to as a "shell." The front face interfaces with and strikes the golf ball. A plurality of grooves, sometimes referred to as "score lines," may be provided on the face to assist in imparting spin to the ball and for decorative purposes. The crown is generally configured to have a particular look to the golfer and to provide structural rigidity for the striking face. The sole of the golf club contacts and interacts with the ground during the swing.

The design and manufacture of wood-type golf clubs requires careful attention to club head construction. Among the many factors that must be considered are material selection, material treatment, structural integrity, and overall geometrical design. Exemplary geometrical design considerations include loft, lie, face angle, horizontal face bulge, vertical face roll, face size, sole curvature, center of gravity, and overall head weight. The interior design of the club head may be tailored to achieve particular characteristics, such as by including hosel or shaft attachment means, perimeter weighting on the face or body of the club head, and fillers within hollow club heads. Club heads typically are formed from stainless steel, aluminum, or titanium, and are cast, stamped as by forming sheet metal with pressure, forged, or formed by a combination of any two or more of these processes. The club heads may be formed from multiple pieces that are welded or otherwise joined together to form a hollow head, as is often the case of club heads designed with inserts, such as sole plates or crown plates. The multi-piece constructions facilitate access to the cavity formed within the club head, thereby permitting the attachment of various other components to the head such as internal weights and the club shaft. The cavity may remain empty, or may be partially or completely filled, such as with foam. An adhesive may be injected into the club head to provide the correct swing weight and to collect and retain any debris that may be in the club head. In addition, due to difficulties in manufacturing one-piece club heads to high dimensional tolerances, the use of multi-piece constructions allows the manufacture of a club head to a tight set of standards.

It is known to make wood-type golf clubs out of metallic materials. These clubs were originally manufactured primarily by casting durable metals such as stainless steel, aluminum, beryllium copper, etc. into a unitary structure comprising a metal body, face, and hosel. As technology progressed, it became more desirable to increase the performance of the face of the club, usually by using a titanium material.

With a high percentage of amateur golfers constantly searching for more distance on their shots, particularly their drives, the golf industry has responded by providing golf clubs specifically designed with distance in mind. The head sizes of wood-type golf clubs have increased, allowing the club to possess a higher moment of inertia, which translates to a greater ability to resist twisting on off-center hits. As a wood-type club head becomes larger, its center of gravity will be moved back away from the face and further toward the toe, resulting in hits flying higher and further to the right than expected (for right-handed golfers). Reducing the lofts of the larger head clubs can compensate for this. Because the center of gravity is moved further away from hosel axis, the larger heads can also cause these clubs to remain open on contact, thereby inducing a "slice" effect (in the case of a right-handed golfer the ball deviates to the right). Offsetting the head and/or incorporating a hook face angle can help compensate for this by "squaring" the face at impact, but often more is required to eliminate the "slice" tendency.

Another technological breakthrough in recent years to provide the average golfer with more distance is to make larger head clubs while keeping the weight constant or even lighter by casting consistently thinner shell thicknesses and using lighter materials such as titanium, magnesium, and composites. Also, the faces of the clubs have been steadily becoming extremely thin, because a thinner face will maximize what is known as the Coefficient of Restitution (COR). The more a face rebounds upon impact, the more energy is imparted to the ball, thereby increasing the resulting shot distance.

Known methods to enhance the weight distribution of wood-type club heads to help reduce the club from being open upon contact with the ball usually include the addition of weights to the body casting itself or strategically adding a weight element at some point in the club. Many efforts have been made to incorporate weight elements into the wood-type club head. These weight elements are usually placed at specific locations, which will have a positive influence on the flight of the ball or to overcome a particular golfer's shortcomings. As previously stated, a major problem area of the higher handicap golfer is the tendency to "slice," which in addition to deviating the ball to the right also imparts a greater spin to the ball, further reducing the overall shot distance. To reduce this tendency, the present patent teaches the placement of weight elements directly into the club head. The placement of weight elements is designed so that the spin of the ball will be reduced, and also a "draw" (a right-to-left ball flight for a right-handed golfer) will be imparted to the ball flight. This ball flight pattern is also designed to help the distance-challenged golfer because a ball with a lower spin rate will generally roll a greater distance after initially contacting the ground than would a ball with a greater spin rate.

SUMMARY OF THE INVENTION

The present invention relates to a large wood-type golf club head with a concave insert. The club head is formed of a plurality of body members that define an interior volume. A first body member is made of a metallic material and includes a sole portion and a face portion. A second body portion is made of a light-weight material, such as plastic, composite, or a very thin sheet of low density metallic material. The second body portion makes up at least a portion of the club head skirt, and includes one or more concave indentations that extends into the interior volume of the club head. These indentations provide structural integrity to the second body portions, which may be very thin panels.

The second body member optionally may also include one or more convex bulges that generally extend away from the interior volume. Inserts, such as weight inserts, may be positioned within the convex bulges. Careful positioning of the weight inserts allows the designer to enhance the playing characteristics of the golf club and tailor the club for a specific swing type. The first body member may form a large portion of the club head sole, and the second body member may form a large portion of the club head crown. This weight positioning further enhances the playing characteristics of the golf club.

The contoured body of the inventive golf club head can be characterized by the ratio of the projected area of the club head to the actual club head surface area. The surface area projected onto horizontal planes is significantly less than the actual club head surface area due to the concave and convex bulges. This ratio preferably is 0.8 or less. Due to selective shaping and placement of the individual components, the average of equivalent density of the club head materials varies over different club head regions. In a central region of the club head, the equivalent density preferably is less than two, while on the outer periphery of the club head the equivalent density preferably is greater than two.

The relative amounts of the various materials used to form the inventive club head can be characterized by a comparison of the ratios of their relative surface areas and their relative densities. Preferably, the relationship is inversely related such that the ratio of the heavier material density to the light-weight material density is between one and five times the ratio of the ratio of the light-weight material surface area to the heavier material surface area. More preferably, the first ratio is between one and three times the second ratio.

The club head may include secondary weights positioned extremely low and back from the striking face. A center point on the sole plate defines the lowest point on the club head, and in one embodiment the center point is located directly below the club head center of gravity when the club head is at a 59° lie angle. The center of gravity of the secondary weights are positioned a predetermined distance from the center point. Preferably, each secondary weight center of gravity is at least 0.5 inch rearward of the center point, at least 0.75 inch from the center point toward the heel for the heel weight or at least 0.75 inch from the center point toward the toe for the toe weight, and a maximum 0.25 inch above the center point, whereby the positions of the secondary weights alter the traditional look of the golf club head by bulging outward of the natural contour of the club head.

The secondary weights may be located by reference to a point at which the hosel centerline intersects the sole plate. This distance is then measured from the back surface of the striking face at the midpoint thereof to determine an intersection point. Preferably, the secondary weights are each at least 1.50 inches rearward of the intersection point, at least 0.75 inch toward either the heel or the toe, and a maximum of 0.25 inch above the center point with the club head at a 59° lie angle.

According to one aspect of the present invention, the club head may be formed of a single material. As the club head has a large volume—at least 400 cc is contemplated, the material must have a relatively lighter density than with conventional club heads. This ensures that the overall weight and mass of the club head is not so great that it becomes unwieldy or does not provide the club designer with enough "discretionary weight" to enhance playability aspects of the resulting golf club. Preferred materials include aluminum and its alloys.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
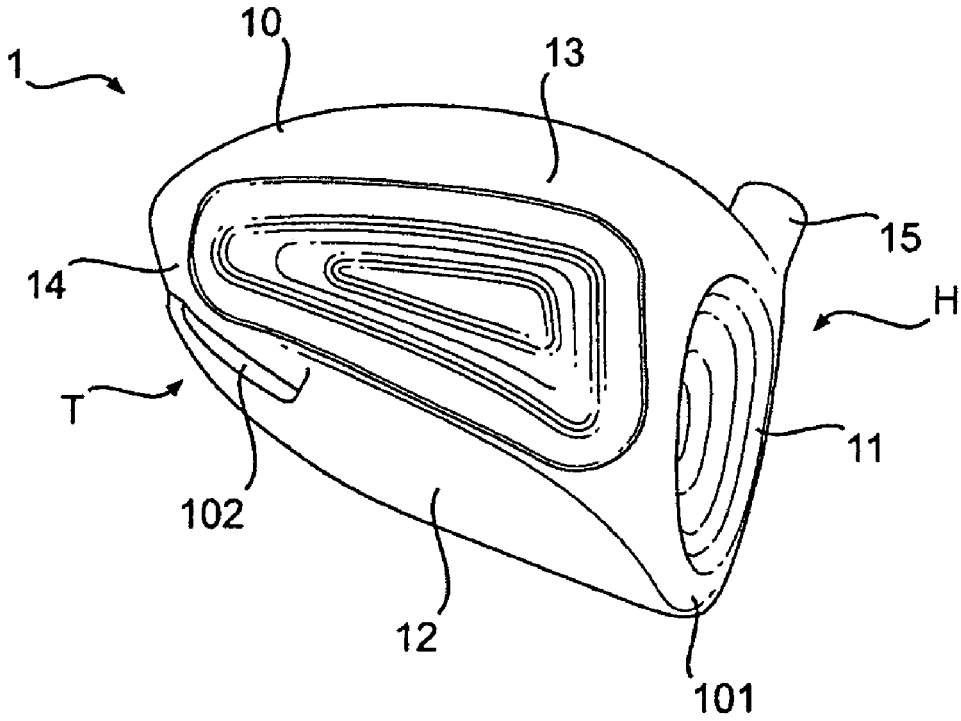
FIG. 1 shows a golf club head of the present invention.

FIG. 1 shows a golf club head 1 of the present invention. The club head 1 includes a body 10 having a strike face 11, a sole 12, a crown 13, a skirt 14, and a hosel 15. The body 10 defines a hollow, interior volume 16. Foam or other material may partially or completely fill the interior volume 16. Weights may optionally be included within the interior volume 16. The face 11 may be provided with grooves or score lines therein of varying design. The club head 1 has a toe T and a heel H.

Figure 2:
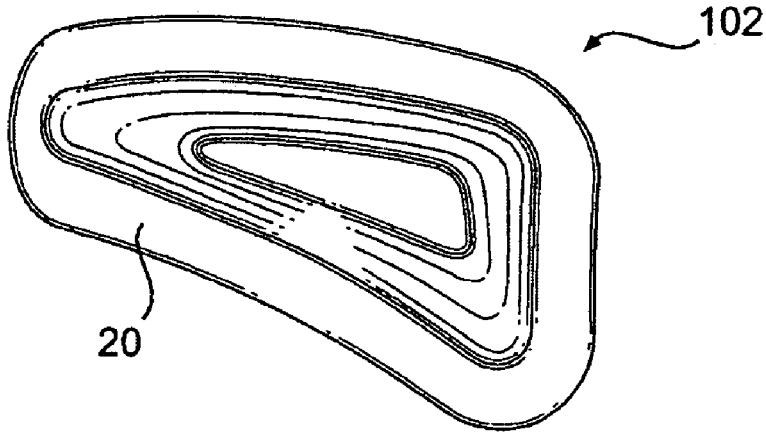
FIG. 2 shows a body member of the golf club head of FIG. 1.

The club head 1 is comprised of a plurality of body members that cooperatively define the interior volume 16. A first body member 101 includes a sole portion and a face portion. The first body member 101 may include a complete face 11 and sole 12. Alternatively, either or both the face 11 and the sole 12 can be inserts coupled to the first body member 101. The club head 1 also includes at least one second body member 102 coupled to the first body member 101 along the skirt 14 in known fashion. The crown 13 can be unitarily a portion of either body member 101, 102 or it may be an insert coupled to either of the body members 101, 102. The second body member 102 includes a concave portion 20 that, when the body members 101, 102 are coupled together, extends inward into the interior volume 16. FIG. 2 shows an isolated view of an exemplary second body member 102.

The first body member 101 preferably is formed of a metallic material such as stainless steel, aluminum, or titanium. The material of the first body member 101 is chosen such that it can withstand the stresses and strains incurred during a golf swing, including those generated through striking a golf ball or the ground. The club head 1 can be engineered to create a primary load bearing structure that can repeatedly withstand such forces. Other portions of the club head 1, such as the skirt 14, experience a reduced level of stress and strain and advantageously can be replaced with a lighter, weight-efficient secondary material. Lighter weight materials, such as low density metal alloys, plastic, composite, and the like, which have a lower density or equivalent density than the previously mentioned metallic materials, can be used in these areas, beneficially allowing the club head designer to redistribute the "saved" weight or mass to other, more beneficial locations of the club head 1. These portions of the club head 1 can also be made thinner, enhancing the weight savings. Exemplary uses for this redistributed weight include increasing the overall size of the club head 1, expanding the size of the club head "sweet spot," which is a term that refers to the area of the face 11 that results in a desirable golf shot upon striking a golf ball, repositioning the club head 1 center of gravity, and/or producing a greater moment of inertia (MOI). Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases, making the club more forgiving for off-center hits since less energy is lost during impact from club head twisting. Moving or rearranging mass to the club head perimeter enlarges the sweet spot and produces a more forgiving club. Increasing the club head size and moving as much mass as possible to the extreme outermost areas of the club head 1, such as the heel H, the toe T, or the sole 12, maximizes the opportunity to enlarge the sweet spot or produce a greater MOI, making the golf club hotter and more forgiving.

The second body member 102 is light-weight, which gives the opportunity to displace the club head center of gravity downward and to free weight for more beneficial placement elsewhere without increasing the overall weight of the club head 1. When the wall thickness of the second body member 102 is at the minimum range of the preferred thickness, a reinforcing body layer can be added in the critical areas in case the member shows deformations. These benefits can be further enhanced by making the second body member 102 thin. To ensure that the structural integrity of the club head 1 is maintained, these thin panels may preferably include a concave portion 20. Inclusion of these concave portions 20 allow the second body member 102 to withstand greater stress—both longitudinally and transversely—without sustaining permanent deformation or affecting the original cosmetic condition, ensuring the structural integrity of the club head 1 is maintained. Preferred thicknesses for the first body member 101 include from 0.03 inch to 0.05 inch, while preferred thicknesses for the second body member 102 include from 0.015 inch to 0.025 inch. Preferably, the concave portion 20 displaces at least 10 cubic centimeters. More preferably, the concave portion 20 displaces at least 25 cubic centimeters. While the club head 1 can be virtually any size, preferably it is a legal club head. A plurality of concave portions 20 may be used with the club head 1. For example, concave portions 20 of uniform or varying size may be positioned in the toe, heel, back, etc.

Figure 3:
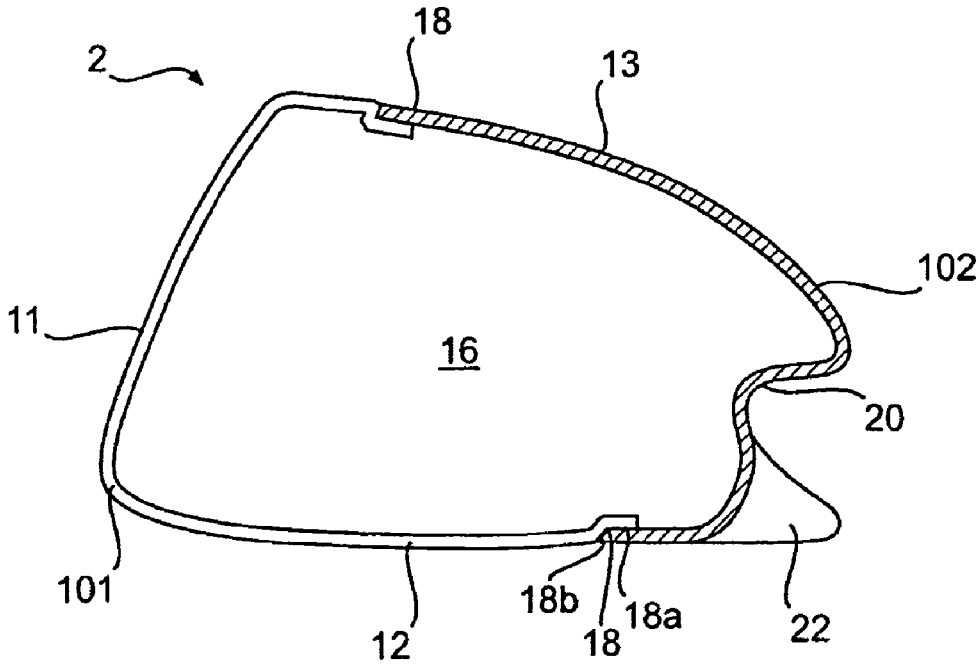
FIG. 3 shows a second club head of the present invention.
Figure 4:
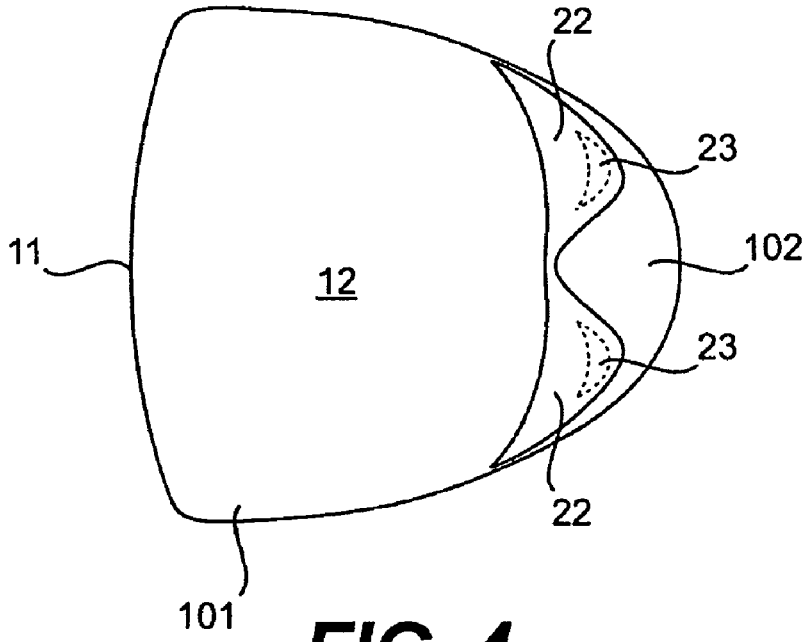
FIG. 4 shows a bottom view of the club head of FIG. 3.
Figure 5:
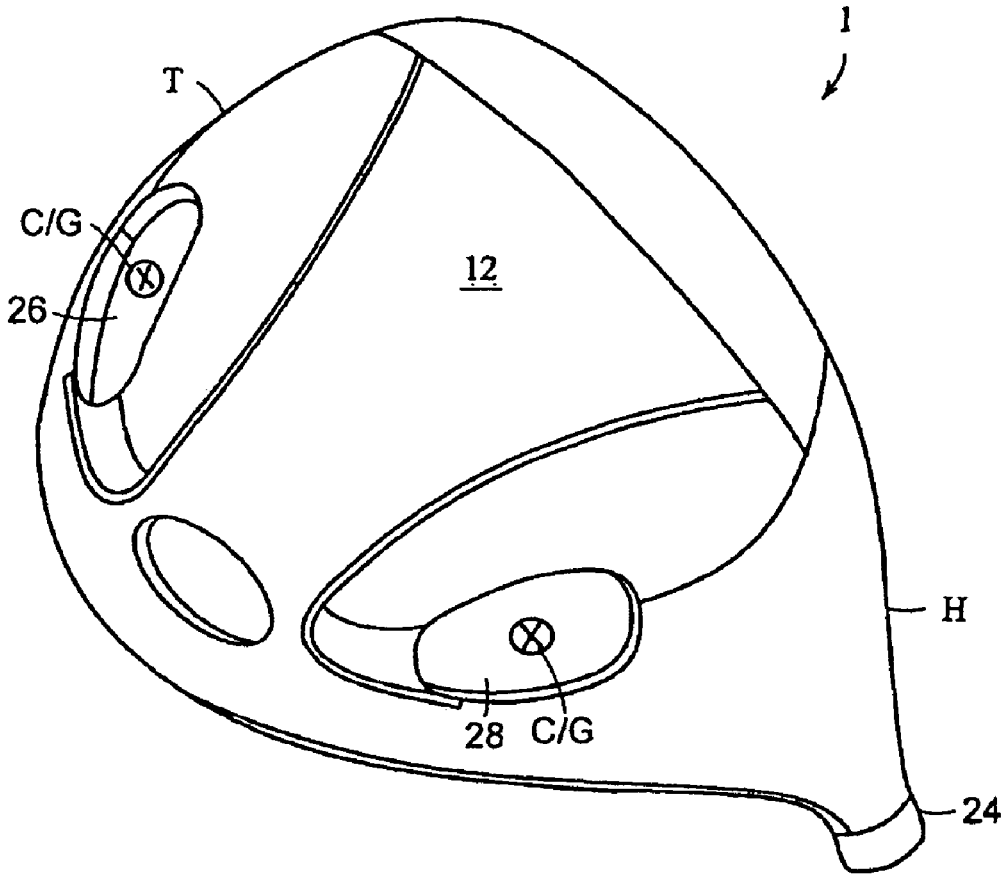
FIG. 5 shows a bottom perspective view of a club head of the present invention.
Figure 6:
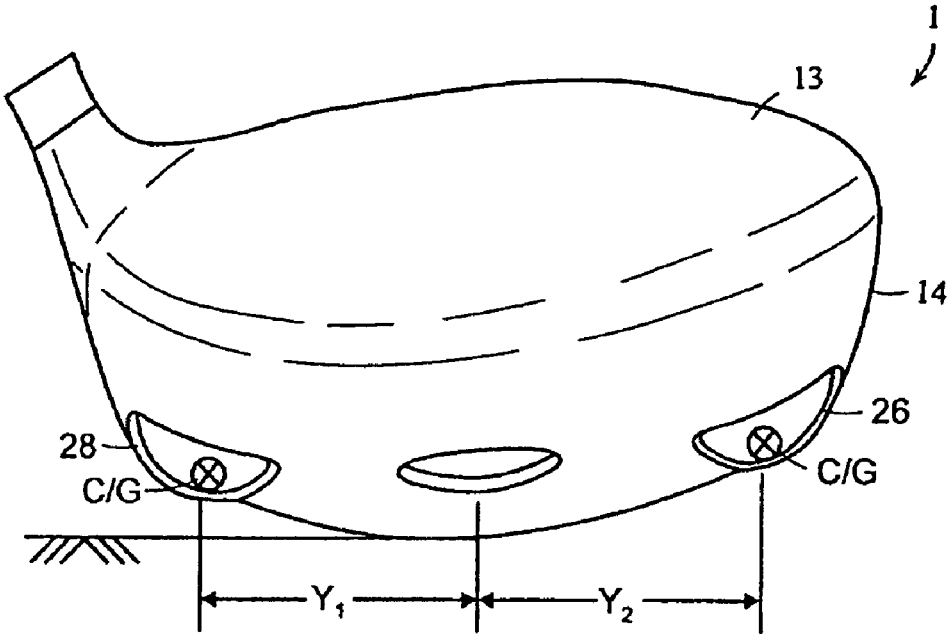
FIG. 6 shows a rear elevation view of the club head of FIG. 5.
Figure 7:
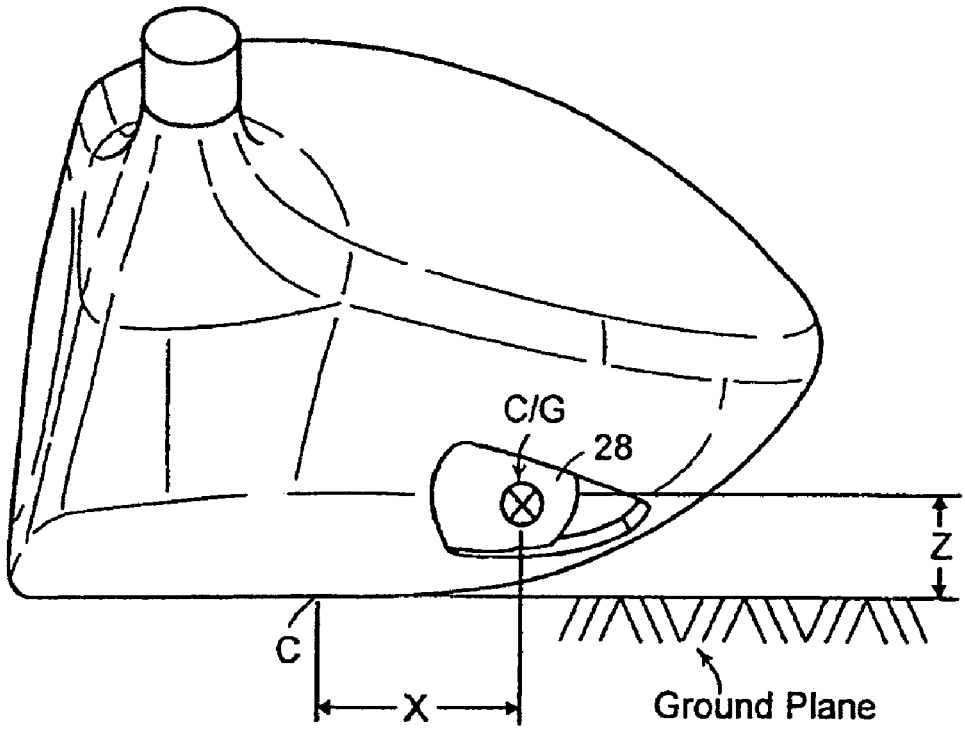
FIG. 7 shows a heel elevation view of the club head of FIG. 5.

FIG. 3 shows a cross-sectional view taken substantially perpendicular to the face 11 of a second club head 2 of the present invention, and FIG. 4 shows a bottom view of the club head 2. In the illustration of this embodiment, the concave portion 20 is positioned at the back of the club head 2. The concave portion 20 preferably is not visible to the golfer at address. In addition to the concave portion 20, the second body member 102 further includes a convex bulge 22 that extends generally away from the interior volume 16. An insert 23 may be positioned within the convex bulge. The insert 23 is not visible from outside the club head 2, and is thus illustrated using broken lines. In a preferred embodiment, the insert 23 is a weight insert. The convex nature of the bulge 23 allows the weight to be positioned to maximize the mechanical advantage it lends to the club head 2. As shown in FIG. 4, the club head 2 may include a plurality of convex bulges 22, such as on a heel side and on a toe side of the club head 2. The club designer may place inserts 23 as desired within the bulges 22. The masses of the inserts may be substantially equal. Alternatively, one of the inserts may have a greater mass than the other. This may be beneficial to design the club to correct a hook swing or a slice swing. A preferred mass range for the weight insert 23 is from 1 gram to 50 grams.

As shown in FIG. 3, the first body member 101 may comprise a majority of the sole 12 and the second body member 102 may include a majority of the crown 13. This beneficially removes a large majority of the mass from the upper part of the club head 2. In this embodiment the first body member 101 includes an attachment perimeter 18 that extends around its edge. The second body member 102 is coupled to the first body member 101 along the attachment perimeter 18. The first and second body members 101, 102 cooperatively define the interior volume 16. The attachment perimeter 18 preferably may contain a step defining two attachment surfaces 18*a*, 18*b*. As illustrated, the second body member 102 may be coupled to both of these surfaces 18*a*, 18*b* to help ensure a strong bond between the body members 101, 102.

While the body members 101, 102 may be formed in a variety of manners, a preferred manner includes forming a complete club head shell (first body member 101) in known manner and removing material to create openings to which the second body member 102 can be coupled. The opening may be created in any desired manner, such as with a laser. The second body member 102 may be joined to the first body member 101 in a variety of manners, such as through bonding or through a snap-fit in conjunction with bonding. If a composite material is used for the concave inserts, molding six plies of 0/90/45/-45/90/0 is preferred.

FIGS. 5-9 illustrate additional aspects of the present invention. In the embodiment illustrated in these figures, the club head 1 includes a crown portion 13, a sole 12, a heel portion H, a toe portion T, a skirt portion 14 connecting the heel portion H to the toe portion T, a front face 11 and a hosel 24 that extends from the heel portion H. The club head 1 can be formed from sheets joined together, such as by welding, or cast, preferably from a titanium alloy. The crown portion 13 can be made from such materials as carbon fiber composite, polypropylene, Kevlar, magnesium, or a thermoplastic. Hosel 24 includes a bore defining a centerline axis C/L.

Figure 8:
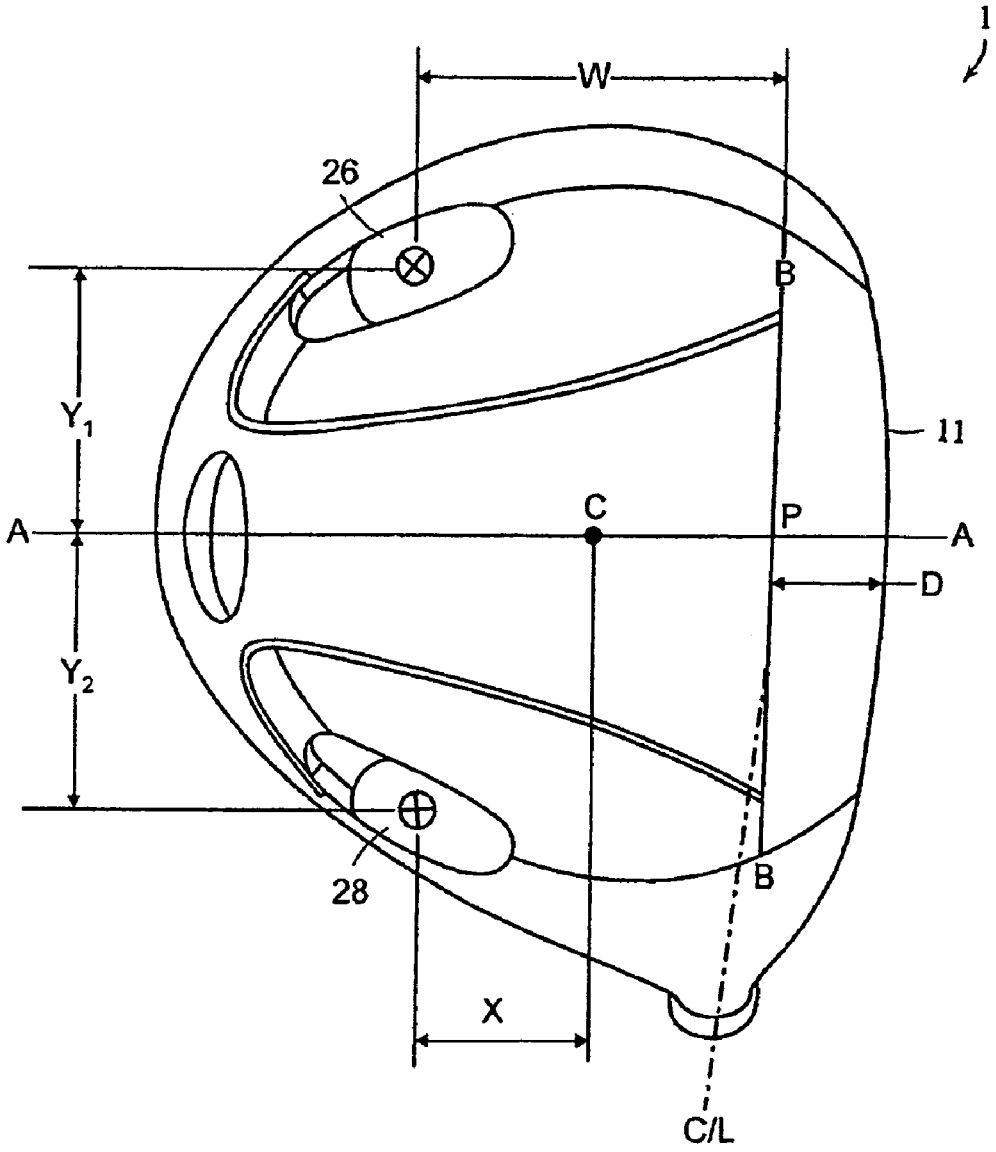
FIG. 8 shows a bottom schematic view of the club head of FIG. 5.
Figure 9:
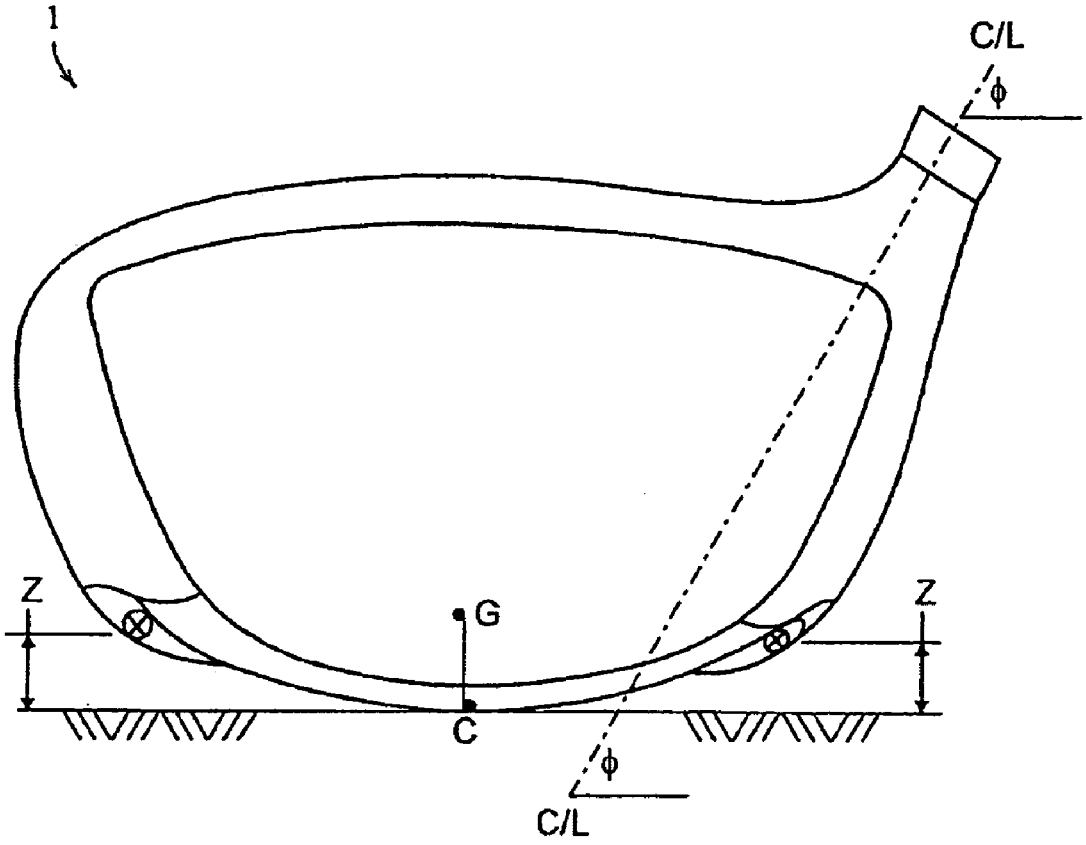
FIG. 9 shows a front cross-sectional view of the club head of FIG. 5.

As best depicted in FIG. 9, the club head 1 of the present invention has a center of gravity G located at an extremely rearward and low position. The location of the center of gravity G is biased by the location of two secondary weights, a toe secondary weight 26 and a heel secondary weight 28, which are both partially outside the traditional look of a golf club head. As shown in FIGS. 5-9, the locations of the two secondary weight elements 26, 28 are established by the relationship of their distances from established points of contact. When the club head is at a lie angle ø of 59°, the lowest contact point of the sole 12 is at a center point C directly beneath the center of gravity G.

One method of establishing the locations of the secondary weights 26, 28 is discussed herein. As shown in FIG. 8, the center line C/L of hosel 24 intersects the sole plate 12 at a distance D from the rear surface of the front face 11. When extending a line B-B that is substantially parallel to the leading edge of the club head (maintaining the distance D), an intersection point P is made with a line A-A that is perpendicular to and extends rearward from the midpoint of the front face 11. The line A-A extends through the middle of the club head 1 and passes directly beneath the club head center of gravity G. This intersection point P may also be defined by the intersection of line A-A and a vertical plane positioned at an intersection of the hosel center line C/L and the sole 12. The center of gravity C/G of each secondary weight 26, 28 is at a distance W of at least 1.50 inches rearward of the intersection point P, a distance Z that is a maximum of 0.25 inch above the lowest point of contact, which is the center point C of the sole plate 12, and each secondary weight is at least 0.75 inch away from line A-A in opposing directions, which is a distance Y1 towards the toe T for the toe secondary weight 26 and a distance Y2 towards the heel H for the heel secondary weight 28.

The locations of the secondary weights 26, 28 may also be determined for the present invention by measuring from the center point C. From center point C, the center of gravity of each secondary weight 26, 28 is a distance X of at least 0.50 inch rearward along line A-A, the distance Z that is a maximum of 0.25 inch above the center point C, and a minimum of 0.75 inch away from line A-A in opposing directions, towards the toe T for the toe secondary weight 26 and towards the heel H for the heel secondary weight 28. Thus, each secondary weight 26, 28 is a minimum of 0.90 inch from the center point C.

The secondary weights 26, 28 can be selected from a plurality of weights designed to make specific adjustments to the club head weight. The secondary weights 26, 28 can be welded into place or attached by a bonding agent. The weights 26, 28 can be formed from typically heavy weight inserts such as steel, nickel, or tungsten. Preferably, the body of the club head 1 is formed from titanium, and the crown portion 13 from a light-weight material such as carbon fiber composite, polypropylene, Kevlar, thermoplastic, magnesium, or some other suitable light-weight material. Preferred volumes of the club head 1 include from 350 cc to 460 cc. The secondary weights 26, 28 preferably range in mass from 2 to 35 grams, with 10 grams to 35 grams being more preferred. It is well known that by varying parameters such as shaft flex points, weights and stiffness, face angles, and club lofts, it is possible to accommodate a wide spectrum of golfers. But the present invention addresses the most important launch consideration, which is to optimize the club head mass properties (center of gravity and moment of inertia) by creating a center of gravity that is low, rearward, and wide of center. The club head 1 of the present invention encompasses areas of the club head that are not typically utilized for weighting because they adversely alter the traditional look of a club head. The design of this club head 1 allows for a portion of the secondary weights 26, 28 to bulge outside the normal contour of the club head.

Figure 10:
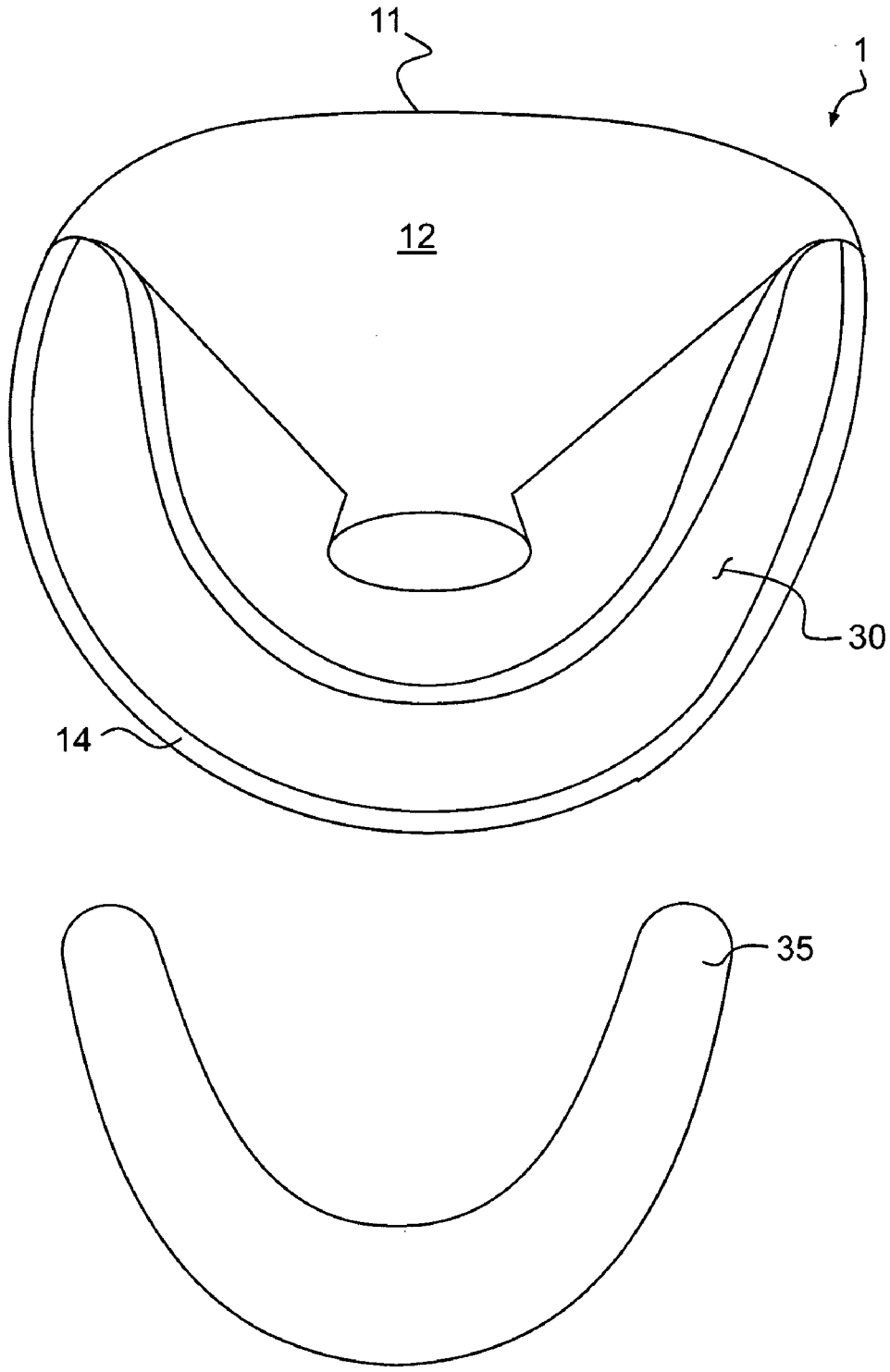
FIG. 10 shows a bottom view of a golf club head of the present invention.

FIG. 10 shows a bottom view of a golf club head 1 of the present invention. The skirt 14 includes an opening 30 towards the rear of the club head 1. An insert 35 is positioned within the opening 30 in known fashion, such as via an attachment perimeter 18, to cooperatively define the interior volume 16. Preferably, the insert 35 is formed of a light-weight material such as a composite material or a polymer material. Using a light-weight insert 35 inherently biases the club head mass toward the sole 12 of the club head 1. It also allows the inclusion of a weight member to achieve a specific moment of inertia and/or center of gravity location while maintaining typical values for the overall club head weight and mass.

Figure 11:
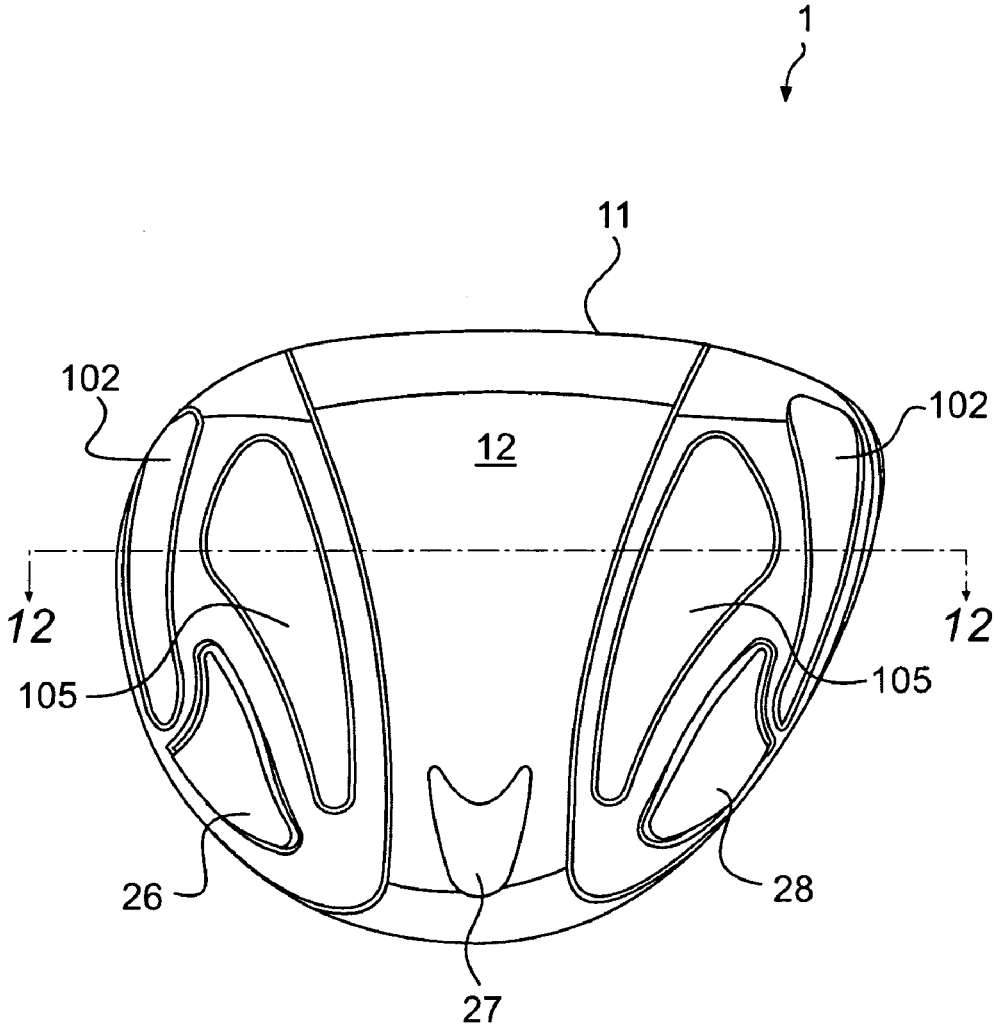
FIG. 11 shows a bottom view of a golf club head of the present invention.

FIG. 11 shows a bottom view of a golf club head 1 of the present invention. In addition to secondary weights 26, 28, the club head 1 includes an insert 27 intermediate the toe secondary weight 26 and the heel secondary weight 28. The insert 27 may be a weight insert similar to the toe and heel secondary weights 26, 28, in which case it also has a preferable mass range of 2 to 35 grams. Alternatively, or in addition to being a weight member, insert 27 may include one or more indicia, such as a model or manufacturer designation. The club head 1 further includes a sole insert 105; in the illustrated embodiment, two such sole inserts 105 are shown. These inserts 105 preferably are formed of a light-weight material as described above. Such materials likely are robust enough to withstand contact with the ground such as the sole 12 incurs through normal use of the golf club. However, the arcuate shape of the sole 12 in the illustrated embodiment minimizes the likelihood of the inserts 105 contacting the ground. Inclusion of the sole inserts 105 frees even more mass for more beneficial placement in the club head, such as at toe insert 26, intermediate insert 27, and/or heel insert 28. The location of the inserts 105 toward the center of the sole 12 inherently biases the mass toward the outer portions of the club head 1, improving the club head MOI.

Figure 12:
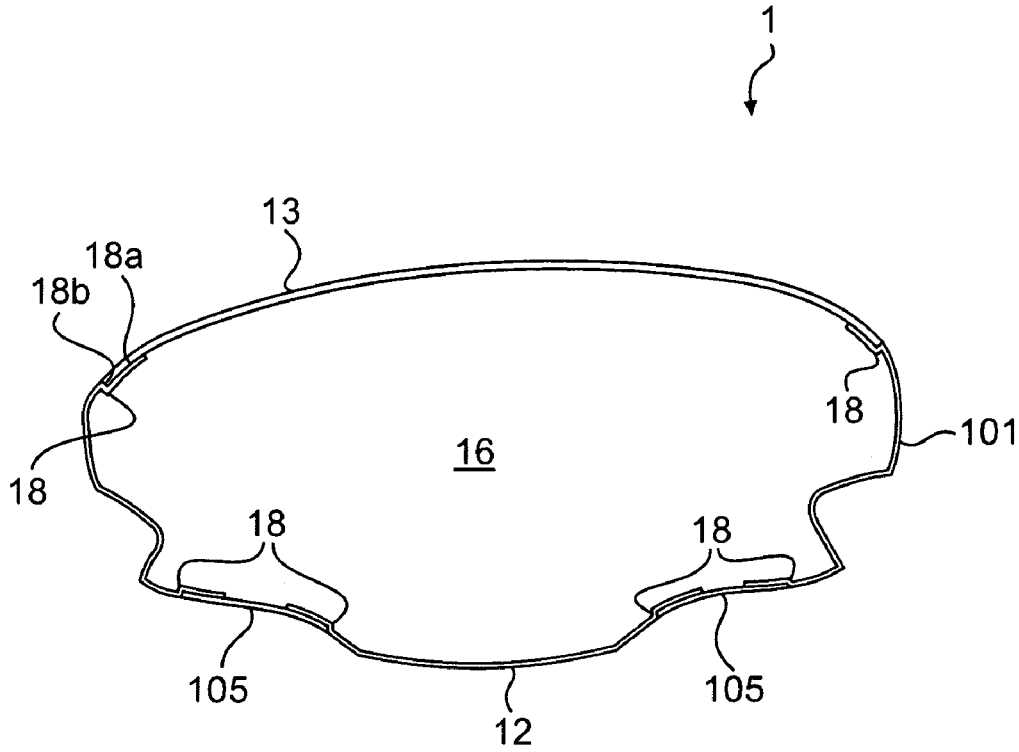
FIG. 12 shows a cross-sectional view of the club head of FIG. 11 taken along line 12-12.

FIG. 12 shows a cross-sectional view of the club head 1 of FIG. 11 taken along line 12-12. Here it is seen that the crown 13 is an insert that is coupled to the metallic first body member 101. The crown insert 13 preferably is formed of a light-weight material, beneficially displacing the club head center of gravity downward and freeing yet more weight for more beneficial placement elsewhere without increasing the overall weight of the club head 1. Due to the inclusion of holes in which to position the crown insert 13, the skirt insert 35, the second body member inserts 102, and the sole inserts 105, the first body member 101 takes on the appearance of a frame. It should be noted that not every insert 13, 35, 102, 105 need be included in a particular embodiment of the present invention, though all may be present. The frame-like nature of first body member 101 is a load bearing structure that ensures that the stresses and strains incurred during a golf swing, including those generated through striking a golf ball or the ground, do not detrimentally affect the light-weight portions of the club head 1, which experience a reduced level of stress and strain. These club head portions, which may include secondary body member 102, crown 13, skirt insert 35, and sole inserts 105, advantageously can be formed of a lighter, weight-efficient secondary material such as low density metal alloys, plastics, composites, and the like, which have a lower density or equivalent density than the previously mentioned metallic materials, beneficially allowing the club head designer to redistribute the "saved" weight or mass to other, more beneficial locations of the club head 1. These portions of the club head 1 can also be made thinner, enhancing the weight savings.

The first body member 101 preferably includes an attachment perimeter 18 for each insert (including the crown 13). These attachment perimeters 18 extend around the edge of the respective openings. Preferably, each attachment perimeter 18 includes a step defining two attachment surfaces 18*a*, 18*b*, which provide additional assurance of a strong bond between the respective club head components. (While each attachment perimeter 18 of FIG. 12 includes a step defining two attachment surfaces 18*a*, 18*b*, such attachment surfaces 18*a*, 18*b* are called-out in only one location for the sake of clarity.)

The openings in the club head 1 into which the inserts 13, 35, 102, 105 are positioned preferably may be created by forming a complete club head shell in known fashion, and then creating the openings therein. One preferred method of creating the openings is by using a laser to remove portions of the metallic material of the first body member 101. This method provides for tight tolerances. The attachment perimeter 18, including attachment surfaces 18*a*, 18*b*, may be formed in a variety of manners, such as machining the first body member 101 after laser cutting the opening in the club head 1.

Each sole insert 105 preferably has a mass of 0.5 gram to 10 grams, and more preferably from 1 gram to 5 grams. The sole inserts 305, as well as the other inserts, may be beveled or stepped slightly to provide a location for any excess adhesive. In one embodiment, the toe and heel sole inserts 26, 28 each have a preferred mass range of 4 grams to 7 grams, while the intermediate insert sole 27 has a preferred mass range of 2 grams to 3 grams. In one embodiment, the thickness of the club head components is tapered such that the walls are thicker towards the face 11 and thinner towards the rear of the club head 1. Such wall thickness tapering frees more mass for more beneficial placement in the club head 1.

As discussed above, certain golf club head geometries have an inherent advantage over typical design shapes with respect to the club head's mass properties, especially in view of the dimension limits mandated by the United States Golf Association (USGA) and the Royal and Ancient Golf Club of St. Andrews (R&A), the governing bodies promulgating the Rules of Golf. Two such properties of particular note are the club head center of gravity (CG) height and the club head MOI in the heel/toe twisting direction about a vertical axis passing through the CG. (The limit for this MOI is 5900 $g \cdot cm^2$.) Further to the discussion above, material selection and distribution plays an important role in determining the club head properties, including these two specific properties.

Modern drivers have gone from predominately made of steel in the 1990s to titanium alloys in the 2000s as the driver size, measured by volume, have gone from around 250 cc to the maximum allowed 460 cc. While maintaining a certain volume as a constant, the surface area of the club head may be varied. A sphere would be the smallest body for a given volume, while a rectangle with twice the footprint can have the same volume as the sphere. What is different about the two objects is that the sphere has a minimum amount of surface area surrounding the enclosed volume while the rectangle has a much greater amount of surface area. With that logic, and the fact that there are inherent limits to how thin walls can be made using certain metals—and furthermore if the walls do reach the desired minimal thickness, secondary durability issues, such as denting, arise—certain materials reach their practical limit. While stiffening ribs can be added to help overcome denting, this becomes a complex and costly solution and may offer only marginal improvement.

Considering for example titanium, which has a density of approximately 4.43 gm/cc, current manufacturing techniques can obtain wall thickness in the range of 0.5-0.7 mm at a reasonable cost. For a "traditional" shaped profile for a 460 cc driver approaching the Rule limits in width and depth of 12.7 cm, the surface area (SA) required is approximately 380 $cm^2$. Using a wall thickness of 0.06 cm, the minimum amount material of titanium required is 101 g titanium (calculated as area·thickness·density). However, certain areas of the club need to be substantially thicker than the minimum wall thickness for a variety of reasons. One such area is the face 11. Variable face thicknesses are typical in modern drivers, with thicknesses ranging from about 0.2 cm near the outer periphery and up to 0.4 cm or more in the central region. Most face areas do not approach the Rule limit of 12.7 cm (5 in)×7.1 cm (2.8 in), which represents a SA of 90 $cm^2$. Certain drivers manufactured by Cobra Golf have a large face area, measuring around 54 $cm^2$. Assuming for calculation purposes that a uniform thickness of 0.28 cm is used for the face to achieve its functional requirements, then 67 g of titanium is needed for the face. Thus the total amount of titanium used is:

$$\begin{aligned}\text{Total amount} &= \text{face mass} + \text{body mass}\\ &= (\text{face } SA \cdot \text{face thickness} \cdot \text{density}) +\\ &\quad ((\text{body } SA - \text{face } SA) \cdot \text{body thickness} \cdot \text{density})\\ &= (54\ \text{cm}^2 \cdot 0.28\ \text{cm} \cdot 4.43\ \text{g/cc}) +\\ &\quad ((380\ \text{cm}^2 - 54\ \text{cm}^2) \cdot 0.06\ \text{cm} \cdot 4.43\ \text{g/cc})\\ &= 67\ \text{g} + 86.6\ \text{g} = 153.6\ \text{g}\end{aligned}$$

For current driver club building specifications having a shaft length of 45.5 in, the overall club head mass is about 200 g. The amount of free mass is thus 46.4 g to optimize certain playing characteristics. Furthermore, the maximum shaft length allowed by the Rules is 48 in, and when shafts are lengthened the heads traditionally become lighter. A rule of thumb is that for every 0.5 in shaft length increase, the head mass must decrease by 5 g. Thus, with a 48 in. shaft, the maximum mass for the club head is 175 g, leaving little discretionary mass for the club head designer to manipulate.

Increasing the face area to the maximum allowable value enhances the playability of the resulting golf club, but presents additional challenges to the club head designer. Namely, the inventive golf club head is contoured to control the club head attributes and volume, which increases the club head body SA. At the same time, the face thickness would most likely need to be increased to maintain its functional requirements. For quick calculations, the following assumptions are made: face SA=76 $cm^2$, face thickness=0.34 cm, body SA=400 $cm^2$, and body thickness=0.06 cm. This results in a club head mass of 200 g, virtually eliminating discretionary mass available to the club head designer for strategically weighting the club head.

This suggests that there is a limit to how much surface area of the club head can be provided in titanium. One aspect of the instant invention is the use of lightweight metallic materials with densities less than 4.0 g/cc as the primary or only (including alloys) material for both the face and body in heads with large volumes (i.e., greater than 400 cc), large overall surface areas (i.e., greater than 350 $cm^2$), large face areas (i.e., greater than 60 $cm^2$), and plan profiles approaching the Rule limits (12.7 cm heel-toe distance, less than 12.7 cm face-back distance). As used herein, plan profile means the smallest rectangle that can be drawn around the widest toe-heel and front-back dimensions of the club head projected onto a plane. The plan profile defines a side wall ratio, which is defined as the widest toe-heel dimension divided by the widest front-back dimension. Preferably, the club head has a plan profile area of at least 130 $cm^2$, and more preferably at least 145 $cm^2$. The inventive club, having these dimensions and materials, has increased forgiveness and increased playability for golfers of various skill levels.

Preferred materials for the inventive club head include aluminum, its alloys, metal matrix aluminum composites, aluminum cermets (ceramic-reinforced metals), and the like. Such materials may have material strengths that are comparable to the widely used titanium alloys. Use of such materials have a density less than 3 g/cc, yielding a lower total club head mass even with increased wall thicknesses. For example, using such an aluminum-based material having a density of 2.8 to form the body and face of a golf club head having an overall surface area of 400 $cm^2$, the face having a surface area of 76 $cm^2$ and a thickness of 0.4 cm, and the body having a thickness of 0.1 cm, the total club head mass is about 175.8 g. This represents a "savings" of more than 24 g relative a titanium-based club head. The club head designer may use this saved mass to strategically position weight members to the club head, increasing the club head MOI, lowering the club head CG, and enhancing the forgiveness and playability of the resulting golf club.

Figure 13:
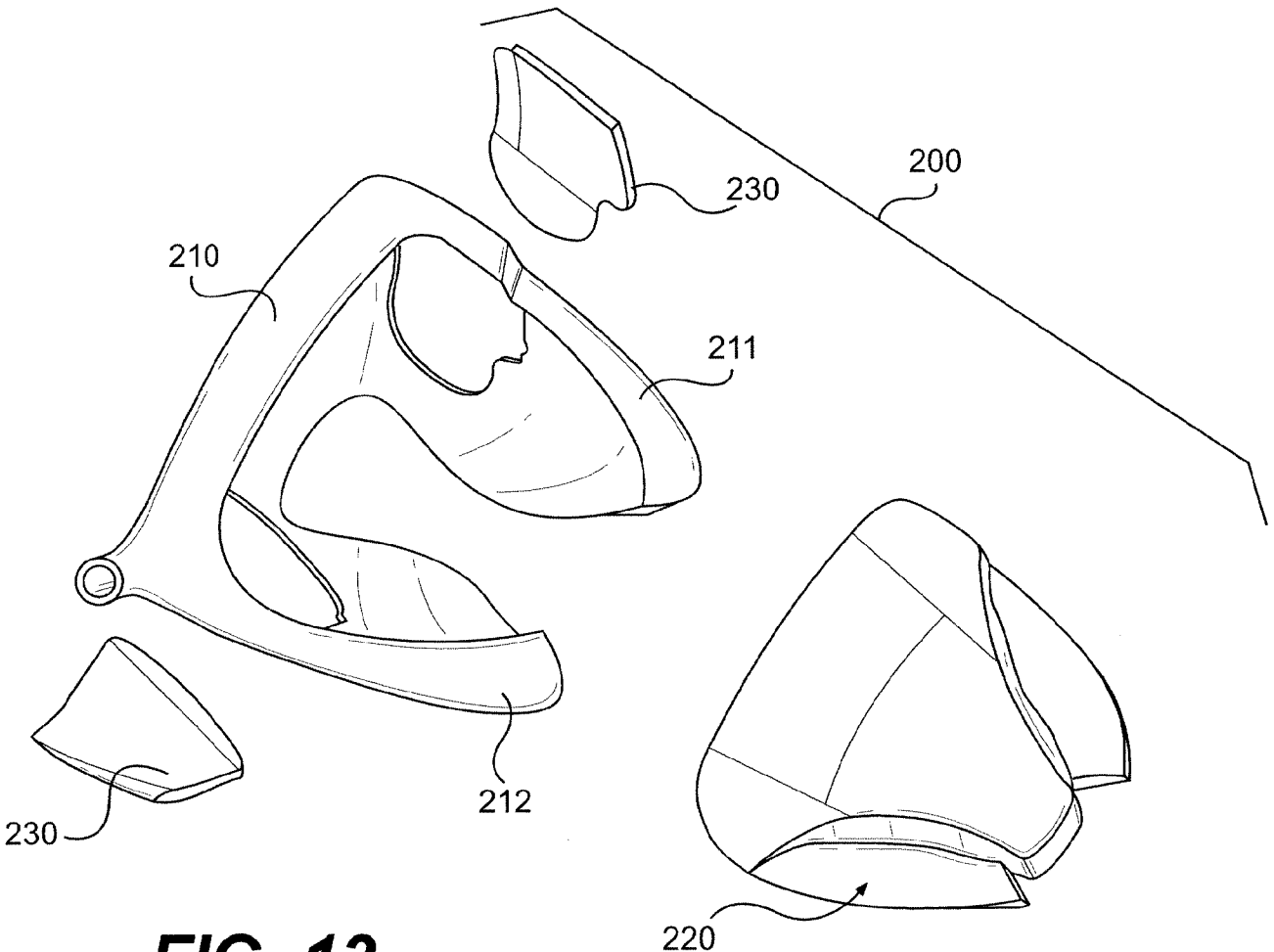
FIG. 13 shows an exploded top view of a golf club head of the present invention.

In an alternate version of the inventive club head, a combination of a relatively heavier material and a lightweight material is used to form the club head body. FIG. 13 shows an exploded top view of a golf club head 200 of the present invention. The club head 200 includes a body formed of two major components. A first component 210 is formed of a relatively heavier material, preferably a metallic material, and includes the strike face 11, which may be an insert or formed integrally therewith. The metallic component 210 further includes wing-like projections 211, 212 extending rearward from toe and heel portions of the face 11, respectively, partially forming the skirt 14 of the club head 200. The wing extensions 211, 212 define voids therebetween, including in crown and sole portions of the club head. Thus, the metallic component 210 has a frame-like design.

A second major component 220 is formed of a lightweight material and cooperates with the metallic component 210 to define the club head 200. Preferred materials for the second component 220 include reinforced plastic and other composites. The first and second components 210, 220 are coupled together in known manner, such as through an adhesive, epoxy, or the like. The components 210, 220 can also be coupled via bladder molding or welding. To facilitate their attachment, the components 210, 220 have corresponding attachment surfaces. Preferably, at least the top, outer surfaces of the projections 211, 212 and corresponding surfaces of the lightweight component 220 are such attachment surfaces. Preferably, at least portions of the bottom, outer surfaces of the projections 211, 212 and corresponding surfaces of the lightweight component 220 are also attachment surfaces.

Figure 14:
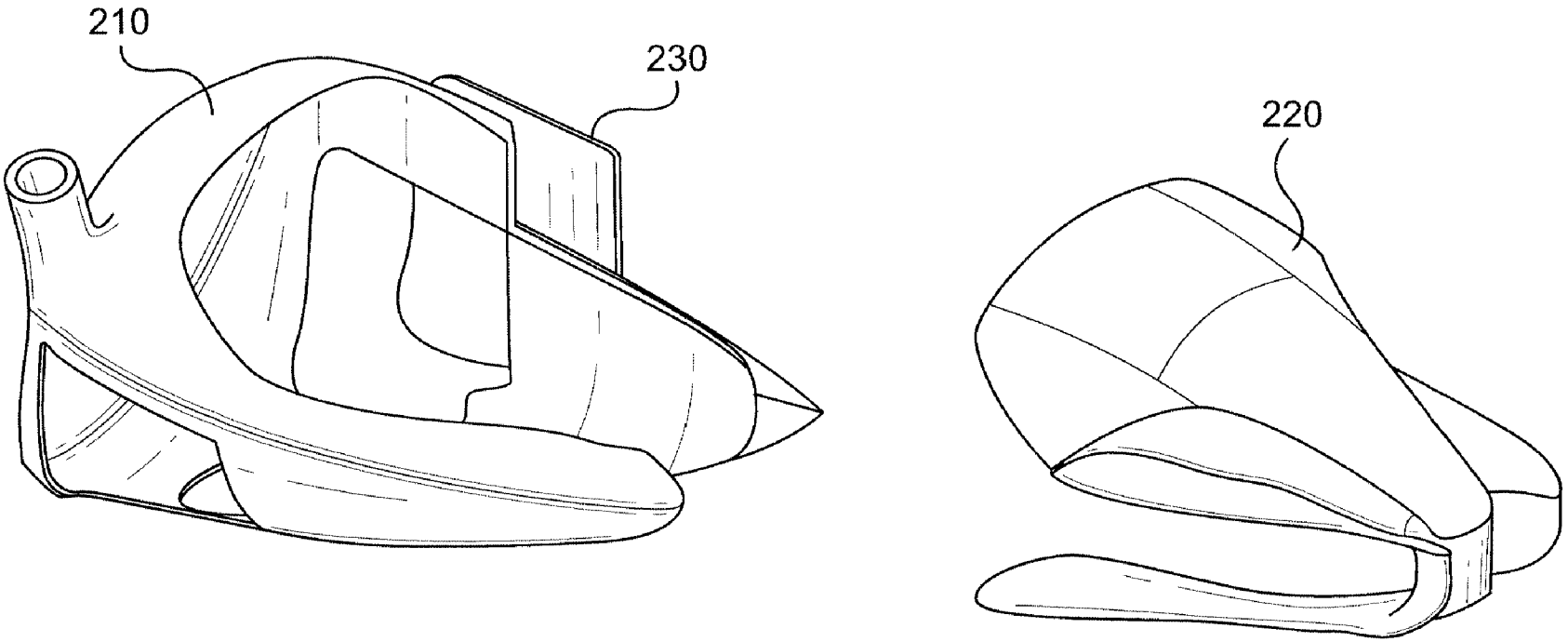
FIG. 14 shows an exploded top view of the golf club head of FIG. 13.

The lightweight component 220 fills in the voids of the metallic component 210. Thus, the lightweight component forms a majority of the crown 13, a rear portion of the skirt 14, and a central portion of the sole 12. This is illustrated in FIG. 14, which shows an exploded side view of the club head 200. By displacing the denser metallic material from the crown, the center of gravity is inherently lowered. Similarly, by displacing the metallic material from the central portion of the sole 13, mass is inherently biased toward the heel and toe of the club head.

Similarly to the second body member 102 discussed above, the club head 200 may further include additional lightweight bodies 230 positioned in front heel and toe portions of the skirt 14, near the strike face 11. Inclusion of such additional lightweight components displaces further metallic material, further allowing the club designer to enhance the playing characteristics of the golf club.

One way to characterize the relative amounts of each material is by a ratio of the surface area comprised by the relatively heavier material and that comprised by the lightweight material. It should be noted that, preferably, the "relatively heavier material" is less dense than the metallic materials typically used to form golf club heads. The aluminum materials discussed above are preferred for the "heavy" material, and carbon fiber or otherwise reinforced plastic composites are preferred for the lightweight material. The surface area ratio may be compared with a ratio of the densities of the two club head components 210, 220. According to one preferred arrangement, $$\frac{A_2}{A_1} < \frac{\rho_1}{\rho_2} \leq 5 \cdot \frac{A_2}{A_1},$$

where $A_1$ is the surface area of the first component 210, $A_2$ is the surface area of the second component 220, $\rho_1$ is the density of the first component 210, and $\rho_2$ is the density of the second component 220. It is the outer surface areas that are being referred to here. More preferably, $$\frac{A_2}{A_1} < \frac{\rho_1}{\rho_2} < 3 \cdot \frac{A_2}{A_1}.$$

Thus, the inventive club head 200 balances the amount of the relatively heavier material (measured as a function of its surface area) with the relative densities of the components 210, 200. Preferably, the first density $\rho_1$ is less than or equal to 3.5, and the first density $\rho_1$ divided by the second density $\rho_2$ is less than 2. The greater the difference in relative densities, the greater is the difference in surface areas. This is an inverse relationship, which an increase in the difference in densities causing a decrease in the surface area comprised by the heavier material.

Figure 15:
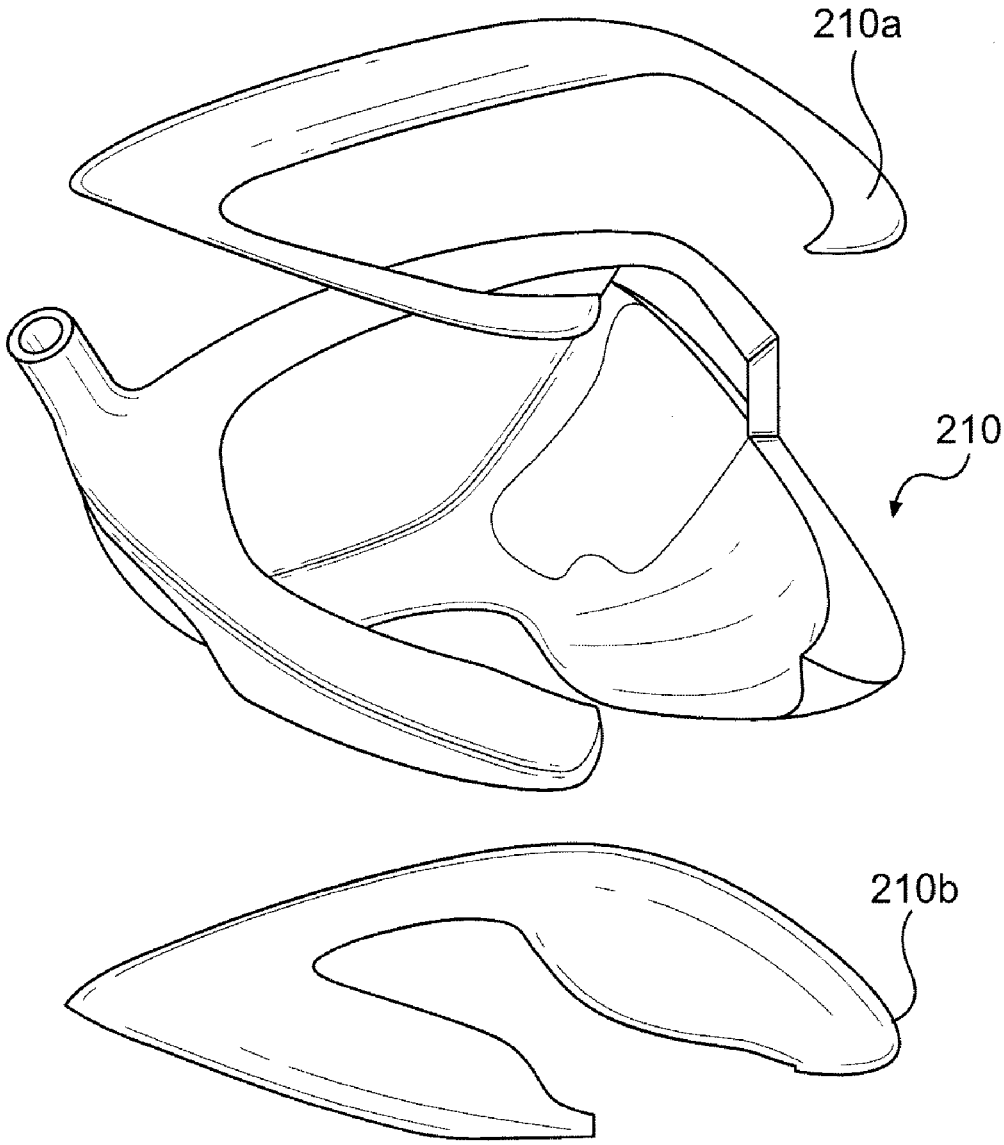
FIG. 15 shows a first club head component and its projected area.
Figure 16:
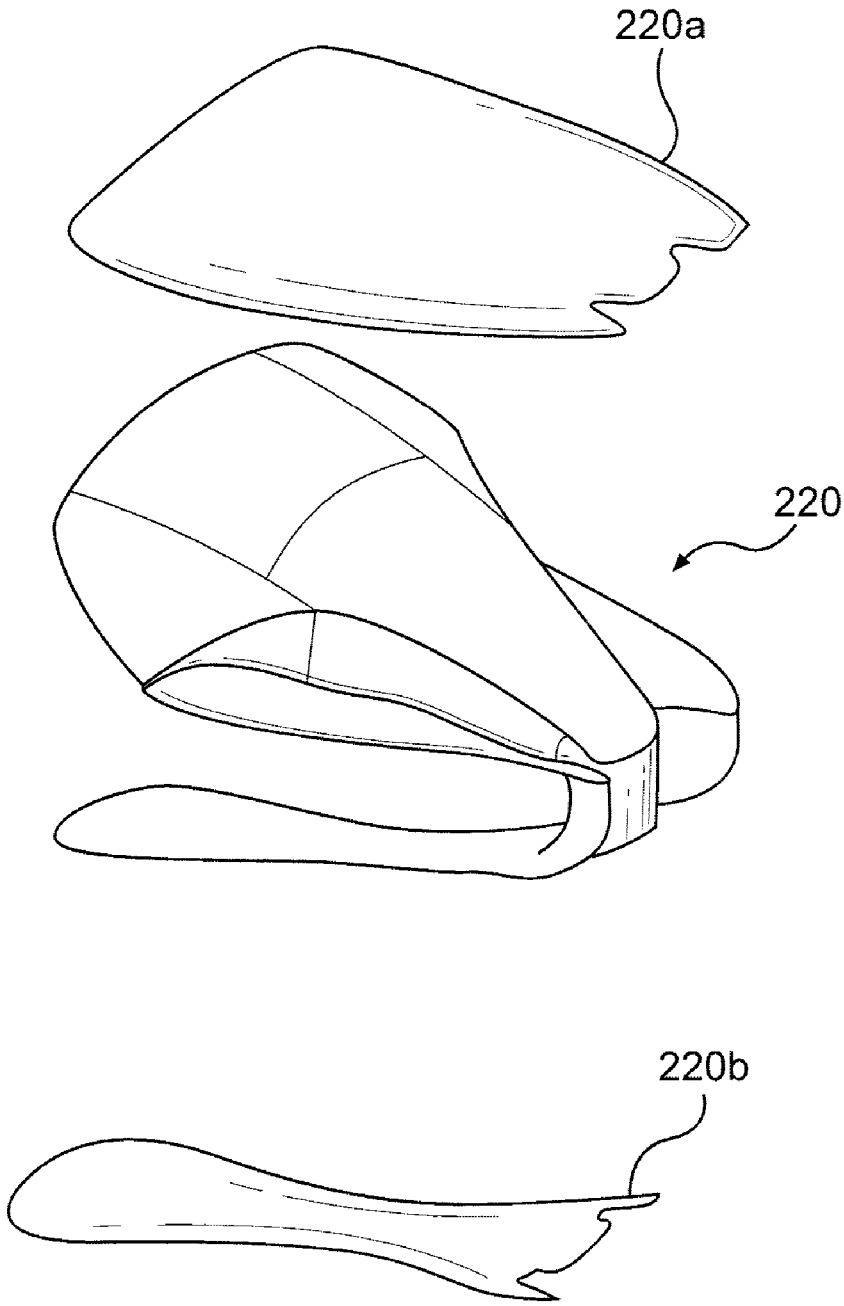
FIG. 16 shows a second club head component and its projected area.

In addition to the amounts of material present in the club head, the present invention additionally controls the placement of the different materials. This material placement aspect may be quantified as a ratio of projected surface area to actual surface area. That is, for a given portion of the club head, the outer surface area of each component 210, 200 forming the club head is projected onto a horizontal plane. FIGS. 15 and 16 illustrate this concept. FIG. 15 shows the heavier first club head component 210. The projected surface area 210*a* shown above the first club head component 210 is a projection onto a horizontal plane of that portion of the component 210 above the crown parting line of the club head components 210, 220. The projected area 210*b* shown below the first club head component 210 is a projection onto a horizontal plane of that portion of the component 210 below the parting line. The projected area for the first club head component 210 is the sum of these partial projections 210*a*, 210*b*. The parting is a convenient location to use to separate the relative club head "halves," thought it is not the only such location available. Similarly, FIG. 16 shows the lighter second club head component 220 with a first projected area 220*a* of that portion of the component 220 above the parting line and a second projected area 220*b* of that portion of the component 220 below the parting line. The projected area for the second club head component 220 is the sum of these partial projections 220*a*, 220*b*.

Due to the contoured nature of the club head, the club head body surface area is increased and the projected area is less than the actual surface area. Preferably, the ratio of projected area divided by actual area is 0.8 or less, and more preferably this ratio is 0.7 or less.

The concept of equivalent density is useful in describing the inventive club head 200. The equivalent density is calculated as the density of the material forming each component as a percentage of the surface area for the component relative the total surface area:

$$\rho_{eq} = \frac{\rho_1 \cdot A_1 + \rho_2 \cdot A_2}{A_1 + A_2},$$

where $\rho_{eq}$ is the equivalent density and the other terms are as defined above.

Figure 17:
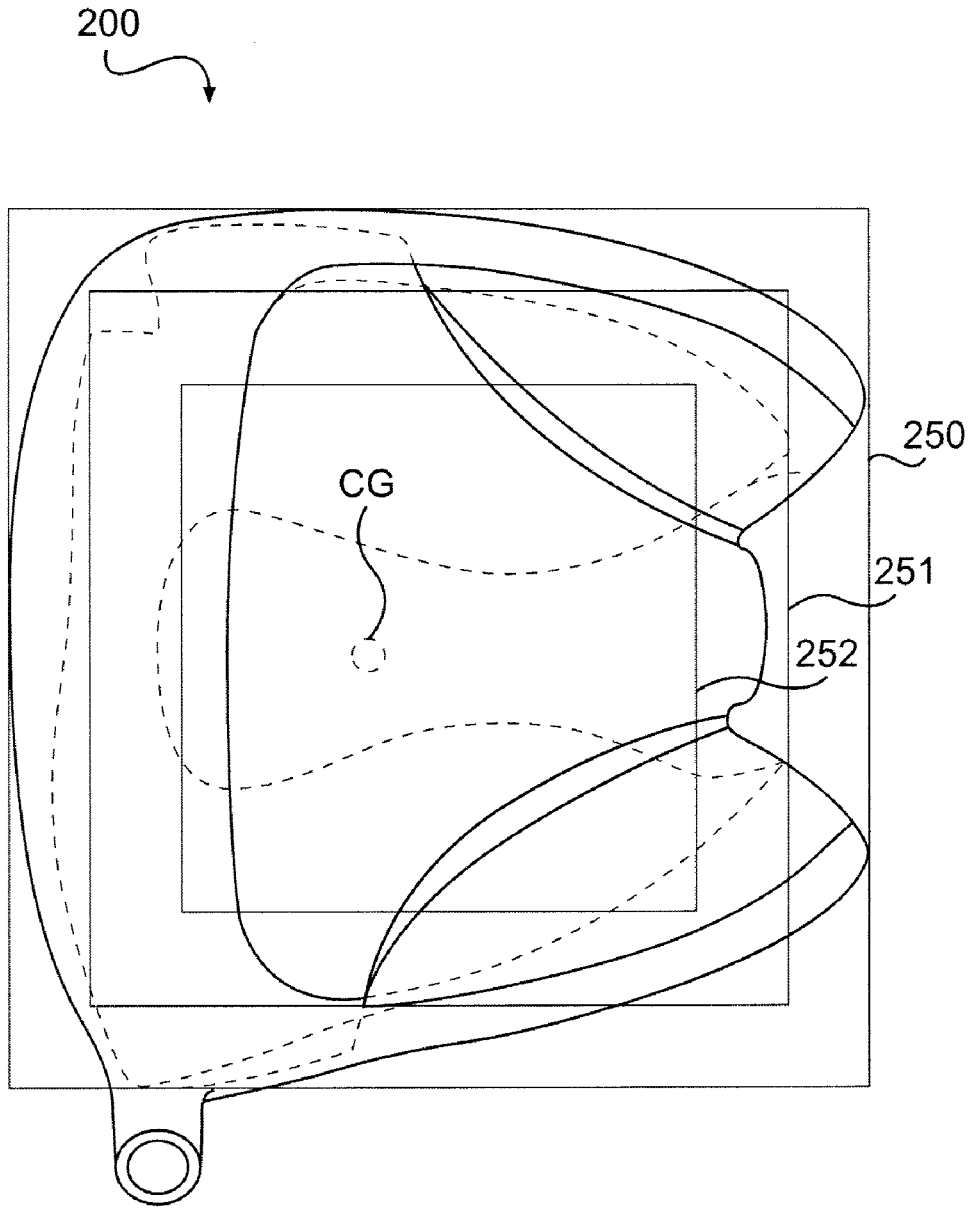
FIG. 17 shows a top view of the club head of FIG. 13.

Of course, equivalent density can be calculated for the entire club head and for specific portions of the club head. FIG. 17 shows a top view of the club head 200 and its plan profile 250. Two additional plan profiles 251, 252 are also shown, with all of the plan profiles 250, 251, 252 having geometric centers that are coincident. Plan profile 251 has an area equal to 90% of the first plan profile 250 area, and plan profile 252 has an area equal to 80% of the first plan profile 250 area. Each of these secondary plan profiles 251, 252 has the same side wall ratio as the primary plan profile 250. Preferably, the inventive golf club head has an equivalent density of less than 2 within the 80% plan profile 252. Preferably, the inventive golf club head also has an equivalent density of greater than 2 between the 90% plan profile 251 and the primary plan profile 250. In another aspect of the present invention, this equivalent density between the 90% plan profile 251 and the primary plan profile 250 is greater than 3, or greater than 4.

Table 1 below shows the attributes of one example of the inventive golf club head 200 and a known golf club head:

TABLE 1

| | Example | Comparative |
|---|---|---|
| Main Body | | |
| ρ | 2.7 | 4.43 |
| SA | 170 | 270 |
| Lightweight insert | | |
| ρ | 1.5 | 1.5 |
| SA | 290 | 110 |
| Club Head | | |
| SA | 460 | 380 |
| $SA_L/SA_H$ | 1.7 | 0.41 |
| $\rho_H/\rho_L$ | 1.8 | 2.95 |

where density ρ is in g/cm$^3$, surface area SA is in cm$^2$, H designates the heavier material, and L designates the lighter material. As shown, the properties of the inventive club head are an improvement over known club heads.

The strike face 11 may be integral with or an insert attached to the first component 210. If an insert, the strike face may be formed of the same material as the first component 210. Alternatively, the face insert may be formed of a different material, such as titanium or a titanium alloy. Thus, the density of the face may be greater than the density of any of the body components.

More than one light-weight material can be used with the inventive golf club head. These components may also be comprised of layers of various light-weight materials. If so, the densities, surface areas, and other attributes mentioned herein are of the actual inserts used rather than just one of the various materials used.

Additionally, the light-weight components of the club head may be treated with a metallic coating to improve their wear resistance. Other coatings may also be used. Preferably, the coating is chosen such that it has only a minor impact, if any, on the club head attributes.

As used herein, directional references such as rear, front, lower, etc. are made with respect to the club head when grounded at the address position. See, for example, FIG. 9. The direction references are included to facilitate comprehension of the inventive concepts disclosed herein, and should not be read or interpreted as limiting.

U.S. Design patent application Ser. No. 29/276,256, now pending, is incorporated herein by reference.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. For example, while two body members have been described above, the present invention may be embodied in a club head having more than two body members. Additionally, the present invention may be embodied in any type of club in addition to the wood-type clubs shown in the illustrated embodiments. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

What is claimed is:

1. A golf club head, comprising:

a first club head component formed of a first material, said first club head component having a first outer surface area, said first material having a first density; and a second club head component coupled to said first club head component to cooperatively form a club head body, said second club head component formed of a second material, said second club head component having a second outer surface area, said second material having a second density less than said first density;

the club head defining a first plan profile, said first plan profile having a first side wall ratio, a first area, and a first geometrical center;

the club head defining a second plan profile having a second area equal to 90% of said first area, said second plan profile having a second side wall ratio equal to said first side wall ratio and a geometrical center that is coincident with said first geometrical center;

the club head defining a third plan profile having a third area equal to 80% of said first area, said third plan profile having a third side wall ratio equal to said first side wall ratio and a geometrical center that is coincident with said first and second geometrical centers; wherein:

within said third plan profile a first ratio of projected area divided by actual area is less than 0.8 and a first equivalent density is less than 2; and between said second plan profile and said first plan profile a second ratio of projected area divided by actual area is less than 0.8 and a second equivalent density is greater than 2.

2. The golf club head of claim 1, wherein said first area is greater than 130 $cm^2$.

3. The golf club head of claim 1, wherein the club head has a total outer surface area of at least 400 $cm^2$.

4. The golf club head of claim 1, further comprising a face insert, said face insert, said first club head component, and said second club head component cooperatively defining the club head.

* * * * *